US006193565B1

(12) United States Patent
Herron

(10) Patent No.: US 6,193,565 B1
(45) Date of Patent: Feb. 27, 2001

(54) SPLICING CONNECTOR

(75) Inventor: Lee S. Herron, Hooksett, NH (US)

(73) Assignee: FCI USA, Inc., Fairfield, CT (US)

( * ) Notice: Subject to any disclaimer, the term of this patent is extended or adjusted under 35 U.S.C. 154(b) by 0 days.

(21) Appl. No.: 09/387,016

(22) Filed: Aug. 31, 1999

(51) Int. Cl.[7] ..... H01R 4/50; H01R 11/01
(52) U.S. Cl. ..... 439/783; 439/391
(58) Field of Search ..... 439/783, 391, 439/784

(56) References Cited

U.S. PATENT DOCUMENTS

| | | | | |
|---|---|---|---|---|
| 3,071,831 | | 1/1963 | Chickvary et al. | 24/126 |
| 3,329,928 | | 7/1967 | Broske . | |
| 3,384,704 | | 5/1968 | Vockroth | 174/90 |
| 4,451,104 | * | 5/1984 | Hodgson et al. | 439/409 |
| 4,634,205 | * | 1/1987 | Gemra | 439/391 |
| 4,698,031 | | 10/1987 | Dawson | 439/863 |
| 4,752,252 | | 6/1988 | Cherry et al. | 439/784 |
| 5,683,273 | | 11/1997 | Garver et al. | 439/784 |

OTHER PUBLICATIONS

Malico Catalog; Anchor Clamps for Bare or Insulated Messenger; p. 1.11, no date available.
Hubbel Fargo Catalog; Side Opening Wedge Dead End Installation Instructions, no date available.
Hubbel Fargo Catalog; Automatic, Full Tension Line Splices; p. 2–2, no date available.

* cited by examiner

*Primary Examiner*—Brian Sircus
*Assistant Examiner*—Brian S. Webb
(74) *Attorney, Agent, or Firm*—Perman & Green, LLP

(57) ABSTRACT

The splicing connector comprising a connector shell, a first wedge, and a second wedge. The connector shell has a general H-shaped cross section which defines a first conductor receiving channel and a second conductor receiving channel opposite of the first conductor receiving channel. The first wedge is located in the first conductor receiving channel for clamping a first conductor within the first conductor receiving channel. The second wedge is located in the second conductor receiving channel for clamping the second conductor within the second conductor receiving channel.

18 Claims, 2 Drawing Sheets

SPLICING CONNECTOR

BACKGROUND OF THE INVENTION

1. Field of the Invention

The present invention relates to splicing connectors and, more particularly, to a splicing connector having slidable wedges for connecting cables to the connector.

2. Prior Art

Splicing connectors having slidable wedges are known in the prior art. U.S. Pat. No. 3,384,704 discloses a high tensile electrical connector for joining stranded cables and having an outer ferrule with a pair of tapered gripping jaw means disposed therein. The ferrule is crimped at both ends onto the cable which pulls the jaw means into tighter engagement with the cable. U.S. Pat. No. 4,689,031 discloses a wire gripping device wherein a tapered jaw assembly is slidably mounted within a tapered tubular shell. The tapered jaw grips a terminal end of a cable introduced into the tubular shell through an opening at one end of the shell. U.S. Pat. No. 5,683,273 discloses an electrical connector having a central member with opposing conical members mounted to the central member. A pair of jaws extend from the central member into each conical member. When the conical member is threaded on the central member the jaws are pushed together in order to grip a conductor therebetween. As exemplified by the above mentioned patents, the splicing connectors, in the prior art, enclose the terminal ends of the cables and do not afford a user access for visual inspection of the engagement between the connector and the cables secured inside the connectors. This, combined with the end insertion entry of the cable into the connectors of the prior art, substantially prevents a user from identifying a partial or inadequate connection between the cable and the connector of the prior art until the connection fails. The present invention overcomes this along with other problems of the prior art.

SUMMARY OF THE INVENTION

In accordance with the first embodiment of the present invention, a splicing connector is provided. The splicing connector comprises a connector shell, a first wedge, and a second wedge. The connector shell has a general H-shaped cross section which defines a first conductor receiving channel and a second conductor receiving channel opposite the first conductor receiving channel. The first wedge is located in the first conductor receiving channel for clamping a first conductor within the first conductor receiving channel. The second wedge is located in the second conductor receiving channel for clamping a second conductor within the second conductor receiving channel.

In accordance with a second embodiment of the present invention, a splicing connector is provided. The splicing connector comprises a connector shell, a first pair of wedge jaws, and a second pair of wedge jaws. The connector shell has an open upper channel for receiving a first conductor therein. The connector shell also has an open lower channel for receiving a second conductor therein. The first pair of wedge jaws is adapted for engaging tapered side walls of the upper channel for clamping the first conductor in the upper channel. The second pair of wedge jaws is adapted for engaging tapered side walls of the lower channel for clamping the second conductor in the lower channel. The open upper channel and the open lower channel are orientated generally reverse to each other. A bottom of the upper channel forms a bottom of the lower channel.

In accordance with a third embodiment of the present invention, a splicing connector is provided. The splicing connector comprises a connector shell, a first set of wedges, and a second set of wedges. The connector shell has a first generally U-shaped section for laying a first conductor therein. The connector shell also comprises a second generally U-shaped section for laying a second conductor therein. The first set of wedges are adapted for clamping the first conductor within the first U-shaped section. The second set of wedges are adapted for clamping the second conductor within the second U-shaped section. The first U-shaped section and the second U-shaped section are orientated generally reverse to each other with a bottom of the first section being connected to a bottom of the second section. The first U-shaped section is disposed between a first end of the shell and the second section. The second section is disposed between the first U-shaped section and a second end of the shell opposite the first end.

In accordance with a method of the present invention, a method for splicing a first conductor to a second conductor is provided. The method comprises the steps of providing a splicing connector having a shell with a first conductor receiving channel and a second conductor receiving channel, laying a terminal end of a first conductor into the first conductor receiving channel, laying a terminal end of a second conductor into the second conductor receiving channel, and inserting wedges into the first conductor receiving channel and into the second conductor receiving channel for respectively clamping the first conductor and the second conductor to the splicing connector. The first conductor receiving channel of the splicing connector shell is an open channel formed in a first side of the shell. The second conductor receiving channel of the splicing connector shell is an open channel formed in a second side of the shell opposite the first side. When the terminal ends of the first conductor and of the second conductor are respectively laid into the first conductor receiving channel and into the second conductor receiving channel, the first and second conductors extend from opposite ends of the splicing connector. The wedges corresponding to the first conductor receiving channel and the wedges corresponding to the second conductor receiving channel are respectively inserted into the first and second channels from opposite ends of the splicing connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
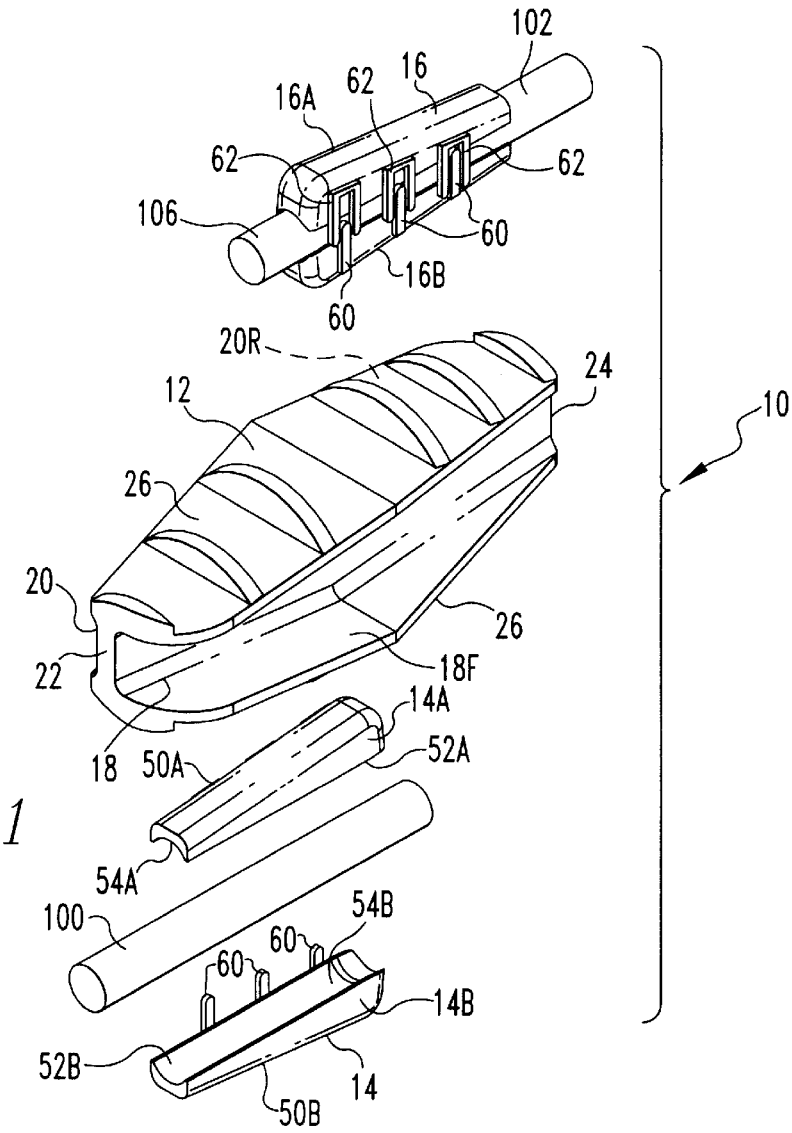
FIG. 1 is an exploded perspective view of a splicing connector incorporating features of the present invention for connecting a terminal end of one conductor to a terminal end of another conductor.

Referring to FIG. 1, there is shown an exploded perspective view of a splicing connector 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
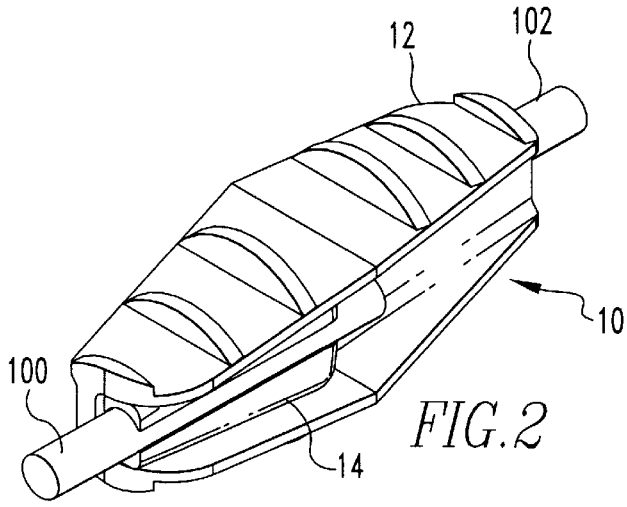
FIG. 2 is a perspective view of the splicing connector in FIG. 1, showing the splicing connector in an assembled configuration.

Referring now to FIGS. 1 and 2, the splicing connector 10 has two conductor receiving channels 18, 20. An electrical conductor 100, 102 is wedged into each channel 18, 20 at each end 22, 24 of the connector 10. The splicing connector 10, thus, connects one conductor 100 at one end 22 of the connector to another conductor 102 at the opposite end 24 of the connector.

Figure 3A:
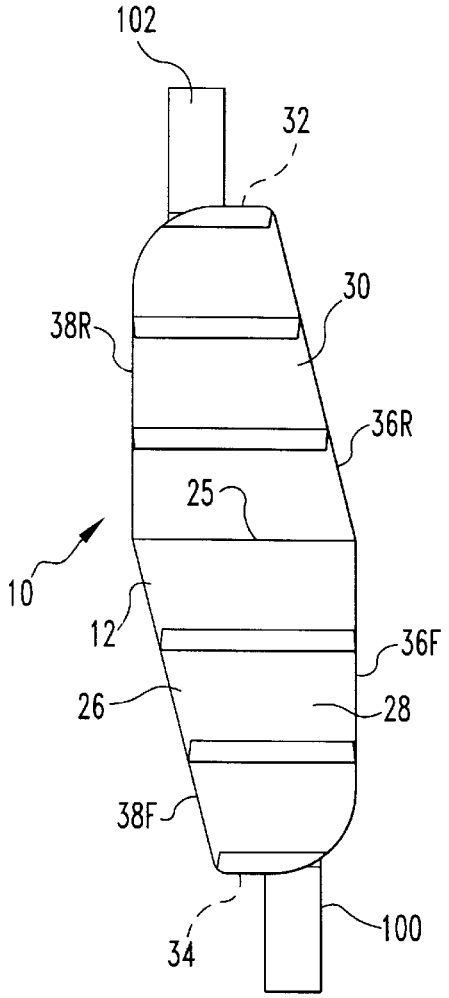
FIGS. 3A–3C are respectively a side elevation, a top plan view and a front elevation of the splicing connector in FIG. 1
Figure 3B:
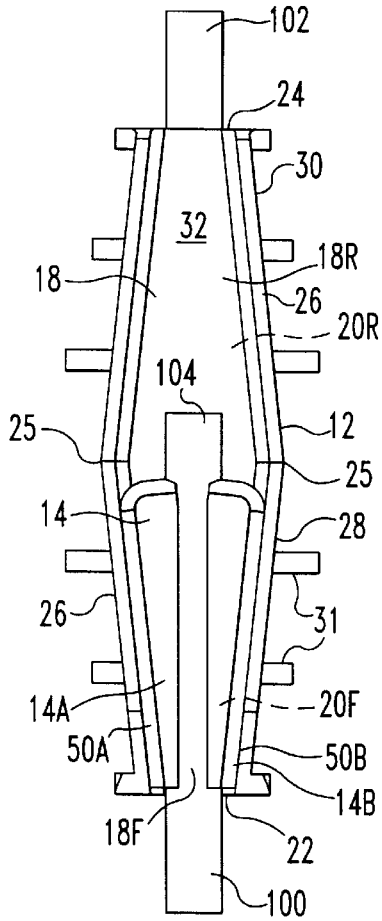
Figure 3C:
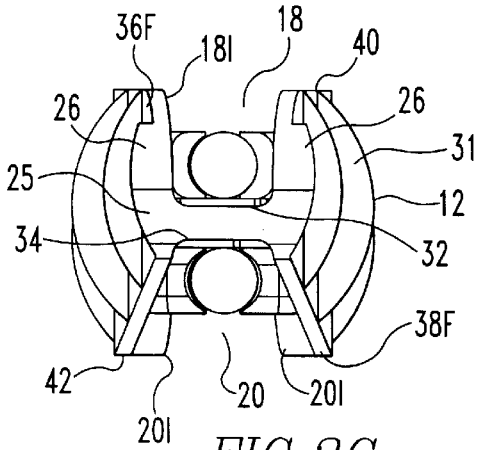

Still referring to FIGS. 1 and 2, the splicing connector 10 of the present invention generally comprises a connector shell 12, and two wedge assemblies 14, 16. The connector shell has two conductor receiving channels 18, 20, formed therein. One wedge assembly 14, 16 is located in each conductor receiving channel 18, 20. Referring now also to FIGS. 3A–3C, the connector shell 12 is preferably a one piece member made from a suitable material such as steel, aluminum, copper, or suitable conductive polymer. The electrical conductor 100, 102 is made from a suitable material such as copper, copper alloy, aluminum, aluminum alloy, or steel. As seen best in FIG. 3C, the connector shell 12 has a pair of vertical side walls 26 and a central web 25 forming a generally H-shaped cross-section. The H-shaped cross-section of the shell defines an upper generally U-shaped channel 18 formed in the top 40 of the shell 12. The H-shaped cross-section also defines a lower generally U-shaped channel 20 formed in the bottom 42 of the shell 12. The lower channel 20 is orientated substantially reverse to the upper channel 18. Accordingly, the bottom 32 of the upper channel 18 is connected to the bottom 34 of the lower channel. In the preferred embodiment, the upper and lower channels 18, 20 extend generally from one end 22 of the shell 12 to the opposite end 24 (see FIG. 3B). In alternate embodiments, the upper channel may be formed only in a portion of the connector shell, and the lower channel may be formed in the same portion of the shell or in another portion so that the upper channel is longitudinally displaced relative to the lower channel. For example, the upper channel may be formed at one end of the shell and the lower channel may be formed at the opposite end of the connector shell.

In the preferred embodiment, the side walls 26 of the connector shell 12 are tapered to form front and rear tapered sections 28, 30 extending from fold line 25 as shown in FIG. 3B. Thus, the upper channel 18 which is bounded by side walls 26 has a front tapered section 18F and an adjoining rear tapered section 18R. Similarly, the lower channel 20 has adjoining front 20F and rear 20R tapered sections formed by the tapered sections 28, 30 of the side walls 26 of the shell 12. As shown in FIG. 3B, the front and rear tapered sections 18F, 18R, of the upper channel have a reverse taper relative to each other. Similarly, the front and rear tapered sections 20F, 20R of the lower channel also have a reverse taper relative to each other. By way of example, the side walls 26 in the front section 28 of the shell 12 taper in towards the front end 22 of the connector shell. Correspondingly, the front tapered section 18F of the upper channel and the front tapered section 20F of the lower channel narrow at the front end 22. The side walls 26 at the rear section 30 of the shell 12 taper in towards the rear end 24, and hence, the rear tapered sections 18R, 20R of the upper and lower channels narrow at the rear end 24 of the connector shell 12. The fold line 25 dividing the front and rear tapered sections 28, 30 of the shell 12 is located substantially in the middle of the shell. Correspondingly, the front and rear section 28, 30 of the shell 12, and the front and rear sections 18F, 20F, 18R, 20R of the upper and lower channels have a substantially symmetrical taper pitch. In alternate embodiments, the upper and lower channels may have a single tapered section formed by tapered side walls of the shell. In these alternate embodiments, the tapers of the lower and upper channels may be reversed so that the upper channel may have a tapering section at the front end and the lower channel may have a tapering section at the rear end of the connector shell or vice versa. In other alternate embodiments, the fold line in the side walls defining two tapered sections of the shell and of the upper and lower channels may be offset relative to the middle of the shell generating asymmetrical tapers of the front and rear sections. In still other alternate embodiments, the side walls of the connector shell may be substantially straight with sloped inner sides forming tapered sections of the upper and lower channels.

The side walls 26 of the connector shell 12, preferably, have reinforcement ribs 31 depending therefrom (see also FIG. 1), though in alternate embodiments, the side walls may have no reinforcement ribs. The side walls 26 may also have drain holes (not shown) formed therein. As seen best in FIG. 3A, the top edges 36F of the side walls 26 along the front section 28 of the shell 12 are substantially flat. Along the rear section 30 of the shell 12, the top edges 36R of the side walls 26 slope down towards the bottom 32 of the upper channel 18. Similarly but in reverse orientation, the bottom edges 38R of the side walls 26 are substantially flat along the rear section 30, and along the front section 28 of the shell 12 the bottom edges 38F of the side walls 26 slope towards the bottom 34 of the lower channel 20 (see also FIG. 3C). In alternate embodiments, the top edges of the side walls in the front section and the bottom edges of the side walls in the rear section may be scalloped or cut out to reduce the depth of the corresponding channels in these sections. The respective inner surfaces 18I, 20I of the upper and lower channels are substantially flat along the height of the corresponding channels. The connector shell 12 may be forged or die cast.

As noted previously, the connector 10 has two wedge assemblies 14, 16 for clamping the conductors 100, 102 to the connector shell 12. Referring to FIG. 1, in the preferred embodiment the two wedge assemblies 14, 16 are substantially the same. Hence, the detailed description of the wedge assemblies 14, 16 provided below will generally refer to only one wedge assembly 14 except as otherwise noted. Each wedge assembly 14, 16 preferably comprises a pair of elongated jaw members 14A, 14B, 16A, 16B, though in alternate embodiments, the wedge assemblies may include any suitable number of jaws. The jaw members may be made from metal or plastic. The two jaw members 14A, 14B in the wedge assembly 14 are substantially symmetrical. Each jaw member 14A, 14B is generally tapered longitudinally. The outer sides 50A, 50B of the jaw member 14A, 14B are sloped to conform to the pitch of the mating tapered section 18F of the channel in the connector shell 12 (see also FIG. 3B). The inner sides 52A, 52B of the jaw members 14A, 14B are orientated to be substantially parallel to a longitudinal axis (not shown) of the channel 18 in the connector shell 12 when the outer sides 50A, 50B of the jaws engage the tapered sides of the channel 18. The inner sides 52A, 52B of the jaw members 14A, 14B have matching conductor locating grooves 54A, 54B with a radius of curvature generally conforming to the circumference of the conductor 100 clamped by the wedge assembly 14 to the connector shell 12. Each pair of jaw members 16A, 16B, 14A, 14B have a number of mating keys 60 and keyways 62. In the preferred embodiment, the keys 60 are disposed on one jaw member 16B, 14B, and the mating keyways 62 are located on the opposite jaw member 16A, 14A (keyways on jaw member 14A not shown). In alternate embodiments, each jaw member of the wedge assembly may have both keys and keyways mating with keys and keyways on the opposing jaw member.

Connection of the splicing connector 10 to the conductors 100, 102 is accomplished generally as described below. As can be realized from FIGS. 1 and 3B, a terminal portion of each conductor 100, 102 is laid into a corresponding open receiving channel 18, 20 of the connector shell 12. By way of example, the terminal portion 104 (see FIG. 3B) of conductor 100 is laid into the front section 18F of the upper channel 18 of the shell 12. Similarly, a terminal portion 106 (see FIG. 1) of conductor 102 is laid into the rear section 20R of the lower channel 20 of the conductor shell. The terminal portions of the conductors 100, 102 are stripped of insulation (not shown) otherwise covering the conductors. The insulation on the terminal portions of the conductors 100, 102 is preferably removed prior to laying the terminal portions into the corresponding receiving channels 18, 20 of the connector shell. The generally U-shaped opposing conductor receiving channels 18, 20 of the connector shell 12 in the present invention accommodates a wide tolerance range in the length of the terminal portions 104, 106 of the conductors 100, 102. For example, if the length of the conductor terminal portion 104 initially laid into the receiving channel 18 is insufficient, which in the present invention can be viewed directly through the open channel 18 (see FIG. 3B), additional insulation may be readily removed to provide a terminal portion of sufficient length. In addition, excess length of the terminal portion 104 of the conductor is accommodated in the rear portion 18R of the receiving channel 18. These advantages are provided by both the upper and lower conductor receiving channels 18, 20 of the connector 10. To clamp the conductors 100, 102 in the upper and lower channels 18, 20 of the connector 10, the wedge assemblies 14, 16 are inserted into the corresponding channels 18, 20. The wedge assembly 14 for the upper channel 18 is inserted forwards into the channel between the sides of the rear section 18R. The wedge assembly 16 for the lower channel 20 is inserted rearward into the channel between the sides of the front section 20F. Each wedge assembly 14, 16 is respectively inserted into its corresponding channel 18, 20 substantially aligned with the conductor 100, 102 located therein so that the conductors are received between the jaw members 14A, 14B, 16A, 16B of the wedge assembly. The slope of the top edges 36R of the side walls 26 in the rear section 18R of the upper channel is sufficient to allow the tapered jaw members 14A, 14B to be inserted into the upper channel 18 with the conductor 100 located therein (see FIGS. 3A–3C) . Similarly, the slope of the bottom edges 38F of the side walls 26 in the front section 20F of the lower channel is sufficient to allow the tapered jaw members 16A, 16B to be inserted into the lower channel 20 with the conductor 102 located therein. Alignment between the jaw members 14A, 14B, 16A, 16B of wedge assemblies 14, 16 is maintained during insertion of the wedge assemblies into the channels 18, 20 by the mating keys 60 and keyways 62 on the opposing jaw members. As the wedge assemblies 14, 16 are inserted into the corresponding channels 18, 20, the tapered sides of the jaw members respectively come into contact with the sides 18I, 20I of the front tapered section 18F of the upper channel and the rear tapered section 20R of the lower channel. Engagement between the tapered jaw members 14A, 14B, 16A, 16B and the mating sides of the tapered channel sections 18F, 20R biases opposing jaw members together to clamp the corresponding conductors 100, 102 located therebetween. The clamping pressure generated by driving the jaw members 14A, 14B, 16A, 16B into the tapered sections 18F, 20R of the connector channels 18, 20 clamps the conductors 100, 102 to the wedge assemblies 14, 16 and clamps the wedge assemblies to the connector shell 12. Thus, the connector 10 effects a splicing connection between one conductor 100 to another conductor 102 (see FIG. 2). During insertion of the wedge assemblies 14, 16 into the channels 18, 20, the conductors 100, 102 are placed in the locating grooves of the opposing jaw members 14, 16 (e.g. grooves 54A, 54B in jaw members 14) to provide uniform clamping pressure on and avoid damaging the conductors 100, 102. Proper placement of the conductors 100, 102 between the respective jaw members 14A, 14B, 16A, 16B of the wedge assemblies can be visually inspected readily in the present invention through the open channels 18, 20 (see FIG. 3B). The vertically flat sides 18I, 20I of the open upper and lower channels 18, 20 of the connector 10 in the present invention provide substantially unencumbered access to a user to visually inspect engagement between the wedge assemblies and the tapered sections of the channels 18, 20. The user can thus readily determine if the wedge assemblies 14, 16 have been engaged sufficiently in the tapered section 18F, 20R of the channels 18, 20. The present invention provides a splicing connector 10 which affords a user access for visual inspection of the engagement between the slidable wedge assemblies 14, 16, the connector shell 12, and the conductors 100, 102 connected to each other by the connector 10. The splicing connectors of the prior art do not provide the user access for visually inspecting engagement between sliding wedges and the cables spliced by the connector. Thus, in the prior art, a poor or incomplete connection between cable and connector generally cannot be identified until the connection failed. This problem is further compounded in the prior art, because the end entry installation of the cables into the splicing connectors of the prior art requires that the length of the terminal portions of the cables inserted into the connector be precise. This results in the user having to perform recuts on the terminal portions to achieve the precise length. In addition, the user cannot visually inspect whether the length of the terminal portion inserted into the connector is adequate and must ultimately rely on guess work. In contrast, the open conductor receiving channels 18, 20 of the splicing connector 10 of the present invention allow lay in installation of the conductors 100, 102. This avoids having to perform recuts to obtain a proper length of the terminal portion located in the connector 10, and allows the user to verify that the length is proper by providing access for visual inspection of the conductors 100, 102 in the channel 18, 20. Furthermore, with the splicing connector 10 of the present invention, the user can also assure a good spliced connection every-time, because the connector 10 provides access for visually inspecting the engagement between wedge assemblies 14, 16, the connector shell 12 and the conductors 100, 102. The H-shaped configuration of the connector shell also allows for rapid and inexpensive fabrication by forging or die casting. This is not possible with the closed connectors of the prior art.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A splicing connector comprising:

a connector shell having a general H-shaped cross-section which defines a first conductor receiving channel and a second conductor receiving channel opposite the first conductor receiving channel;

a first wedge located in the first conductor receiving channel for clamping a first conductor within the first conductor receiving channel; and a second wedge located in the second conductor receiving channel for clamping a second conductor within the second conductor receiving channel;

wherein the first conductor receiving channel has side walls forming a first tapered section and a second tapered section of the first channel, the first tapered section narrowing at a first end of the connector shell and the second tapered section tapering opposite to the first section and narrowing at a second end of the shell opposite the first end.

2. A splicing connector in accordance with claim 1, wherein the connector shell is a one piece member.

3. A splicing connector in accordance with claim 1, wherein the second conductor receiving channel has side walls forming a first tapered section and a second tapered section of the second channel, the first tapered section of the second channel narrowing at the first end of the shell and the second tapered section of the second channel tapering opposite to the first section of the second channel and narrowing at the second end of the shell.

4. A splicing connector in accordance with claim 3, where in the side walls of the first channel are of sufficient height in the first section to engage the first wedge, and have a reduced height in the second section than in the first section of the first channel for allowing the first wedge to be inserted between the side walls of the second section of the first channel when clamping the first conductor.

5. A splicing connector in accordance with claim 3, wherein the side walls of the second channel are of sufficient height in the second section to engage the second wedge, and have a reduced height in the first section than in the second section of the second channel for allowing the second wedge to be inserted between the side walls of the first section of the second channel when clamping the second conductor.

6. A splicing connector in accordance with claim 1, wherein the first wedge comprises a first pair of wedge jaws, and the second wedge comprises a second pair of wedge jaws, and wherein the first conductor is disposed between the first pair of wedge jaws for clamping the conductor in the first conductor receiving channel, and the second conductor is disposed between the second pair of wedge jaws for clamping the second conductor in the second conductor receiving channel.

7. A splicing connector in accordance with claim 6, wherein each jaw of the first and second pairs of wedge jaws has a tapered side for engaging a mating side wall of a corresponding one of the channels, and has a conductor locating groove on a side of the jaw opposite the tapered side.

8. A splicing connector in accordance with claim 6, wherein one jaw of each pair of jaws has at least one guide key for cooperating with a mating keyway formed in an opposite jaw of each pair of jaws, and for aligning one jaw to the opposite jaw in each pair of jaws when each pair of jaws is wedged into a corresponding one of the conductor receiving channels.

9. A splicing connector in accordance with claim 1, wherein the first conductor receiving channel has substantially flat sides for providing access for visual inspection of wedge engagement in the first conductor receiving channel, and wherein the second conductor receiving channel has substantially flat sides for providing access for visual inspection of wedge engagement in the second conductor receiving channel.

10. A splicing connector in accordance with claim 1, wherein the connector shell has reinforcing ribs on exterior sides of the first and second conductor receiving channels.

11. A splicing connector comprising:

a connector shell having an open upper channel for receiving a first conductor therein, and an open lower channel for receiving a second conductor therein;

a first pair of wedge jaws adapted for engaging tapered side walls of the upper channel for clamping the first conductor in the upper channel; and a second pair of wedge jaws adapted for engaging tapered side walls of the lower channel for clamping the second conductor in the lower channel;

wherein the open upper channel and the open lower channel are orientated generally reverse to each other, and wherein a bottom of the upper channel forms a bottom of the lower channel.

12. A splicing connector in accordance with claim 11, wherein the upper channel tapered side walls for engaging the first pair of wedge jaws narrow towards a first end of the connector shell, and wherein the lower channel tapered side walls for engaging the second pair of wedge jaws narrow towards a second end of the connector shell opposite the first end.

13. A splicing connector in accordance with claim 12, wherein the first pair of wedge jaws are inserted from the second end of the connector shell to engage the tapered side walls of the upper channel, and the second pair of wedge jaws are inserted from the first end of the connector shell to engage the tapered side walls of the lower channel.

14. A splicing connector in accordance with claim 11, wherein the tapered side walls of the upper channel form a space therebetween providing access for visual inspection of engagement between the first pair of wedge jaws and the first conductor and between the first pair of wedge jaws and the side walls of the upper channel, and wherein the tapered side walls of the lower channel form a space therebetween providing access for visual inspection of engagement between the second pair of wedge jaws and the second conductor and between the second pair of wedge jaws and the side walls of the lower channel.

15. A method for splicing a first conductor to a second conductor, comprising the steps of:

providing a splicing connector having a shell with a first conductor receiving open channel formed in a first side of the shell and a second conductor receiving open channel formed in a second side of the shell opposite the first side;

laying a terminal end of a first conductor into the first conductor receiving channel;

laying a terminal end of a second conductor into the second conductor receiving channel, the first and the second conductors extending from opposite ends of the splicing connector; and inserting wedges into the first conductor receiving channel and into the second conductor receiving channel for respectively clamping the first conductor and the second conductor to the splicing connector wherein the wedges corresponding to the first conductor receiving channel and the wedges corresponding to the second conductor receiving channel are respectively inserted into the first and second channels from opposite ends of the splicing connector.

16. A method in accordance with claim 15, wherein the step of inserting the wedges comprises inserting the wedges corresponding to the first conductor receiving channel into the first channel from one end of the splicing connector opposite the connector end from which the first conductor extends.

17. A method in accordance with claim 15, wherein the step of inserting the wedges comprises inserting the wedges corresponding to the second conductor receiving channel into the second channel from one end of the splicing connector opposite the connector end from which the second conductor extends.

18. A splicing connector comprising:

a connector frame having a first open channel for receiving a first conductor therein, and a second open channel for receiving a second conductor therein;

a first pair of wedge jaws adapted to be disposed in the first open channel for clamping the first conductor in the first open channel to the connector frame; and a second pair of wedge jaws adapted to be disposed in the second open channel for clamping the second conductor in the second open channel to the connector frame;

wherein, the first pair of wedge jaws are inserted into the first open channel from an end of the connector frame from which the second conductor extends out of the connector frame.

* * * * *